US006126516A

United States Patent [19]

Barrier et al.

[11] Patent Number: 6,126,516

[45] Date of Patent: Oct. 3, 2000

[54] CENTRIFUGAL BLASTING APPARATUS

[75] Inventors: Ronald G. Barrier, Newnan; Khai H. Nguyen, LaGrange; John T. Pokorski, Peachtree; Matthew D. Shorrock, LaGrange, all of Ga.

[73] Assignee: United States Filter Corporation, Lowell, Mass.

[21] Appl. No.: 09/309,074

[22] Filed: May 10, 1999

[51] Int. Cl.[7] ..... B24C 5/06

[52] U.S. Cl. ..... 451/38; 451/40; 451/95; 451/96; 451/97

[58] Field of Search ..... 451/38, 40, 95, 451/96, 97, 98, 39

[56] References Cited

U.S. PATENT DOCUMENTS

| | | | |
|---|---|---|---|
| Re. 20,538 | 10/1937 | Minich . | |
| 1,462,786 | 7/1923 | Cleveland . | |
| 1,996,885 | 4/1935 | Schemmann et al. . | |
| 2,049,466 | 8/1936 | Minich . | |
| 2,077,635 | 4/1937 | Minich . | |
| 2,077,638 | 4/1937 | Minich . | |
| 2,108,211 | 2/1938 | Rosenberger et al. . | |
| 2,127,274 | 8/1938 | Steuart . | |
| 2,135,510 | 11/1938 | Hollingsworth . | |
| 2,204,618 | 6/1940 | Peik . | |
| 2,301,508 | 11/1942 | Blount . | |
| 2,493,215 | 1/1950 | Barnes . | |
| 2,590,573 | 3/1952 | Rinia . | |
| 2,590,576 | 3/1952 | Rosenberger et al. . | |
| 2,789,804 | 4/1957 | Toulmin, Jr. . | |
| 3,368,308 | 2/1968 | Physioc, III . | |
| 3,436,867 | 4/1969 | Fuerst . | |
| 3,678,629 | 7/1972 | Leliaert . | |
| 3,872,624 | 3/1975 | Ramaswamy . | |
| 3,936,979 | 2/1976 | Fuerst . | |
| 4,207,712 | 6/1980 | Toedtli . | |
| 4,244,150 | 1/1981 | Goff . | |
| 4,249,350 | 2/1981 | Goff | 451/98 |
| 4,329,819 | 5/1982 | May . | |
| 4,333,278 | 6/1982 | Schulte et al. . | |
| 4,402,163 | 9/1983 | Carpenter et al. . | |
| 4,473,972 | 10/1984 | Leliaert . | |
| 4,480,413 | 11/1984 | Schulte et al. . | |
| 4,509,300 | 4/1985 | Carpenter et al. . | |
| 4,646,483 | 3/1987 | Mangan . | |
| 4,759,156 | 7/1988 | Baumgart . | |
| 4,941,296 | 7/1990 | Carpenter . | |
| 4,941,297 | 7/1990 | Carpenter | 451/98 |
| 5,081,801 | 1/1992 | Fylak . | |
| 5,205,085 | 4/1993 | Urakami . | |
| 5,209,024 | 5/1993 | Carpenter et al. . | |
| 5,472,369 | 12/1995 | Foster et al. . | |
| 5,476,412 | 12/1995 | Stoltz . | |
| 5,688,162 | 11/1997 | Williams . | |
| 5,702,289 | 12/1997 | Champaigne . | |
| 5,888,125 | 3/1999 | Kuehn | 451/98 |

OTHER PUBLICATIONS

Wheelebrator, "Equipment Modernization Packages," Ideas. The Wheelabrator Corporation, "Ultrablast" Continuous Tumblast—A New Concept for Small Part Continuous In–Line Cleaning Systems, 1993.

(List continued on next page.)

*Primary Examiner*—Eileen P. Morgan
*Attorney, Agent, or Firm*—Wolf, Greenfield & Sacks, P.C.

[57] ABSTRACT

A centrifugal blasting apparatus is configured to deliver friable media without destroying a large percentage of the delivered media. The centrifugal blasting apparatus includes a compressed air feed system that intermixes and fluidizes blast media with compressed air and delivers the fluidized blast media to a blast wheel. The control cage is formed with rounded interior surfaces to avoid sharp transitions that may otherwise fracture the media. The blades are curved to maximize accelleration of the blast media with the lowest possible rotational rate. The first edges of the blades, adjacent the axis of rotation, are configured to receive the blast media. Specifically, the first edges are rounded to minimize the amount of blast media that is broken by using a sharp leading edge. The channels on the blades themselves are also polished to minimize the amount of blast media that is broken while traveling along the surface of the blades.

19 Claims, 4 Drawing Sheets

OTHER PUBLICATIONS

Wheelabrator, "6 Cubic Ft. Tumblast® TBR–6 Rubber Belt, TBS–6 Steel Belt," © 1998 The Wheelabrator Corporation CC Jul. 1994.

The Wheelabrator Corporation, "Wheelabrator Installation Services," Bulletin No. 13.08, © 1990.

The Wheelabrator Corporation, "Wheelabrator has Pangborn® parts?."

The Wheelabrator Corporation. "Wheelabrator has Goff® parts?."

Wheelabrator, "Setting The Standards In Surface Preparation," B13.00A, © 1988 The Wheelabrator Corporation CC Feb. 1994.

The Wheelabrator Corporation, "Surface preparation For Plate, Structural Steel & Pipe," Bulletin 60.00 CC Mar. 1994, © 1990.

The Wheelabrator Corporation, "The Wheelabrator Bi–Directional Wheel," © 1993, CC4/96.

CENTRIFUGAL BLASTING APPARATUS

BACKGROUND OF THE INVENTION

1. Field of the Invention

The present invention relates to an apparatus for blasting a surface and, more particularly, to a centrifugal blasting apparatus that is configured to deliver friable media without destroying a large percentage of the delivered media.

2. Description of the Related Art

It is often desirable to clean a surface by hurling small particles of blast media against the surface, such as to remove paint, rust and/or other coatings or built-up debris. In other situations, blasting the surface of an article may impart desirable qualities to the surface. One such situation in which this occurs is in the aerospace industry, where it has been found that blasting a surface of an article will place the surface of the article in compressive stress. This has been found to reduce the likelihood that the surface will crack or otherwise degrade when undergoing cyclic loading. Stressing the surface of an article by blasting the surface is referred to as peening. The term "blast" and "blasting" will be used herein generically to refer to any application in which small particles are hurled at a surface at a relatively high rate of speed. Exemplary applications include cleaning, descaling, deburring, deflashing, peening, etching, product appearance enhancement and numerous other similar applications.

There are two main types of devices that can be used for blasting. One common system is known as an air blast system. In an air blast system, a stream of compressed air carrying the blast media is released through a fixed nozzle, or manipulated by an operator or robotic device, and allowed to impinge a work surface. Although air blast systems are widely used, one drawback to using an air blast system is that the effective work area for the system is relatively small. For example, a conventional air blast system having a ⅜ inch diameter nozzle fed by a 30 HP compressor may propel approximately 30 pounds of media per minute, with an effective work surface area of about 2 $in^2$. Air blast systems also are relatively noisy and require large or powerful air compressors.

Another type of device that can be used for blasting is a centrifugal blast system. In a centrifugal blast system, a spinning wheel is used to accelerate the blast media. Centrifugal blast systems are capable of delivering much more blast media over a much larger area than a comparable air blast system, while using less power and generating less noise. In a typical centrifugal blast system, the blast media enters a spinning wheel (referred to herein as a blast wheel) at a central location and is radially accelerated by centrifugal force toward the outside of the blast wheel. The blast wheel is typically provided with several similarly configured radially mounted blades, or vanes, that serve to channel and accelerate the blast media. The exit velocity of the particles of blast media leaving the blast wheel may be adjusted, inter alia, by adjusting the size of the blast wheel or by adjusting the rotational velocity of the blast wheel.

Many blasting applications use metallic particles as blast media. However, where ferrous contamination is undesirable or unacceptable or a particular surface finish is required, such as in the automotive, die casting and aerospace industries, metallic media typically cannot be used. In these applications, non-metallic media must be used, such as glass beads, ceramic beads, plastic beads, agri-shell, and baking soda. Likewise, it may be desirable to replace metallic media with softer non-metallic media for certain applications, such as removing paint and coatings while preserving the condition of the underlying surface. Since many non-metallic blast media are breakable, non-metallic media will be referred to hereinafter "friable."

Unfortunately, when a friable blast media is used with a conventional centrifugal blast apparatus, a large percentage of the media are destroyed. For example, it has been found that up to approximately 50% of the friable media is destroyed in one cycle through a conventional centrifugal blast apparatus. Since typical centrifugal blast systems recover and recycle the blast media, destruction of blast media significantly increases the cost of operation of the system. Accordingly, what is needed is a centrifugal blasting apparatus that is configured to deliver friable media with minimal destruction of the delivered media.

SUMMARY OF THE INVENTION

This invention relates to a centrifugal blasting apparatus that is configured to deliver friable media without destroying a large percentage of the delivered media.

According to a first aspect of this invention, a centrifugal blasting apparatus includes a blade mounted for rotation about an axis of rotation and curved in the direction of rotation, the blade having a first end proximal the axis of rotation and a second end distal the axis of rotation, a passage configured to deliver blast media from a source of blast media to the blade, the passage having at least one wall configured to smoothly redirect a direction of travel of the blast media, and an inlet formed in the passage and configured to intermix a flow of fluid with the blast media to facilitate movement of the blast media through the passage. Optionally, the centrifugal blasting apparatus may include a plurality of similarly configured blades and the passage may include a control cage.

The blade first end may be curved, and in particular may have a radius of curvature of approximately ⅛ inch. The surface of the blade may include a channel configured to direct a path of travel of the blast media from a first end of the blade to a second end of the blade. The surface of the channel may be relatively smoothly polished. An insert may be included on a first end of the blade. The insert may be softer than the blade, and optionally may be formed of at least one of urethane and ultrahigh molecular weight plastics. The blades may also include reinforcing ribs.

According to another aspect of this invention, a centrifugal blasting apparatus, includes a motor having a drive shaft and configured to provide motive force to a centrifugal blasting wheel, a plurality of curved blades connected to the drive shaft, each of the curved blades having a first end proximal the axis of rotation and a second end distal the axis of rotation, and a blast media feed system interposed between a source of blast media and the curved blades, the blast media feed system being configured to receive and intermix a flow of compressed air and a flow of blast media, and being configured to deliver the intermixed flow of compressed air and blast media to the first ends of the blades. Optionally, a coupling device may be interposed between the blades and drive shaft or the blades may be directly connected to the drive shaft In this aspect, the blast media feed system may include a control cage and a feed spout, wherein the blast media and compressed air are intermixed in the feed spout, and wherein the control cage is formed to have at least one curved wall configured to smoothly redirect the flow of the intermixed blast media and compressed air from a first direction to a second direction prior to being delivered to the first ends of the blades.

According to yet another aspect of this invention, a blade for a centrifugal blasting apparatus, includes a body, a first end of the body configured to receive blast media, a second end of the body configured to deliver blast media to a work surface, and a surface formed between the first end and the second end and configured to guide the blast media from the first end to the second end. In this aspect, the first end of the blade is curved to ease transition of the blast media onto the blade. Optionally, the blade may be curved and have a stiffening rib running longitudinally along at least a portion of the blade to provide structural rigidity to the blade and to facilitate removal of the blade. An insert may be formed in the first end of the blade, and the surface may be flat, curved, form a channel or be polished.

According to yet another aspect, a method of accelerating abrasive particles, includes providing a centrifugal blasting apparatus having a plurality of curved blades mounted for rotation about a central axis, each of the plurality of blades having a curved inner edge, intermixing blast media with compressed air, and delivering the intermixed blast media and compressed air to the curved inner edge of the blades while the blades are rotating about the central axis.

BRIEF DESCRIPTION OF THE DRAWINGS

This invention is pointed out with particularity in the appended claims. The above and further advantages of this invention may be better understood by referring to the following description when taken in conjunction with the accompanying drawings, in which:

DETAILED DESCRIPTION

The present invention relates to a centrifugal blasting apparatus that is configured to deliver friable media without destroying a large percentage of the delivered media. Although one embodiment of such a centrifugal blast apparatus is illustrated in the accompanying drawings and described in the following text, the invention is not limited to any particular configuration except as set forth in the claims.

Figure 1:
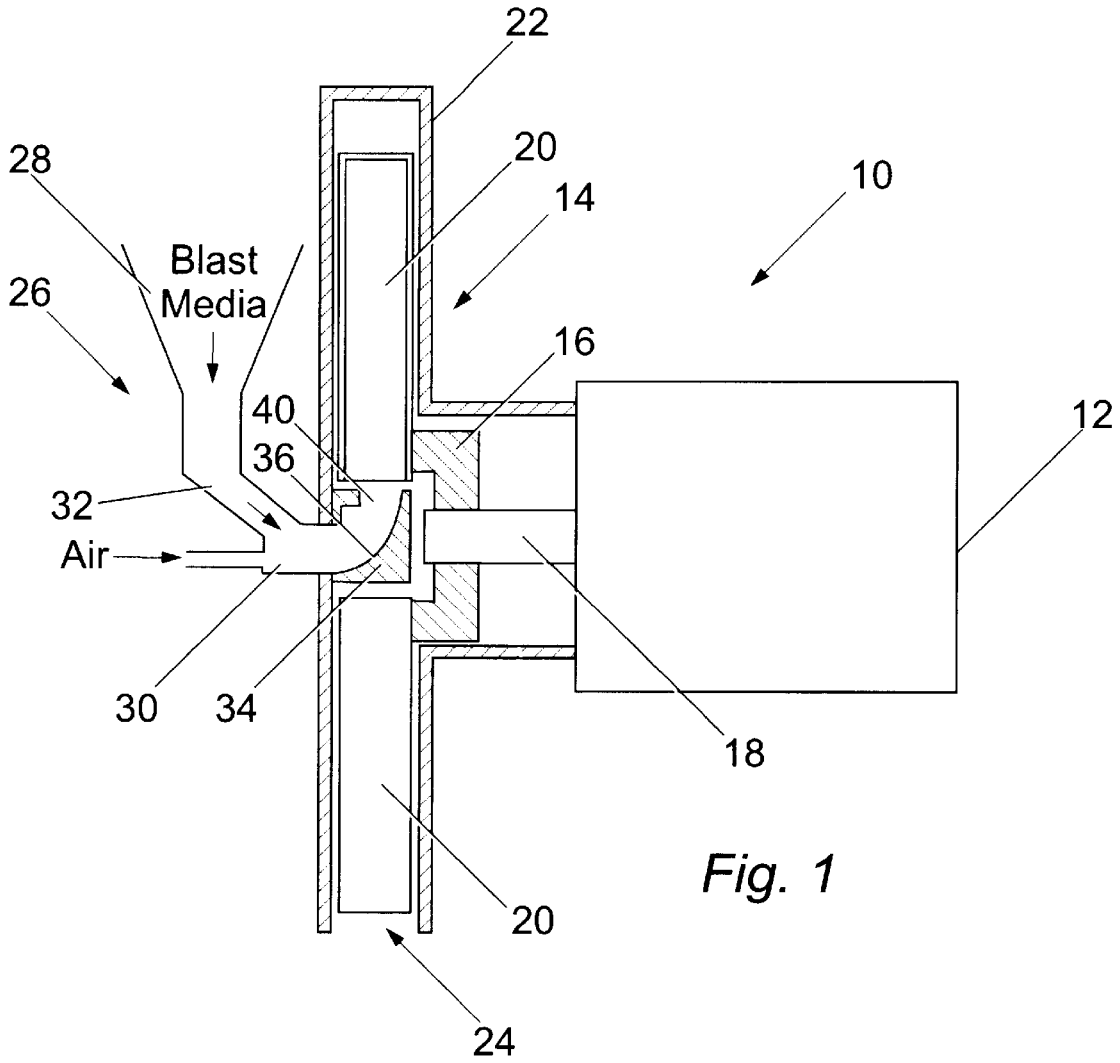
FIG. 1 is a side elevation view, in partial cross-section, of a centrifugal blast apparatus according to a first embodiment of this invention.

In the embodiment shown in FIG. 1, a centrifugal blast apparatus 10 has a motor 12 that is configured to provide rotational driving force to a wheel 14. The motor 12 may be any known motor that is capable of producing a rotational driving force, such as an electric motor or solenoid, a motor fueled by one or more fossil fuels such as an internal continuous gas or diesel engine, a pneumatic motor, a hydraulic motor, a steam engine, or any one of a number of other motors.

A coupling 16 transmits the rotational driving force from the motor 12 to the wheel 14. The coupling 16 may couple an output shaft 18 directly to the wheel 14 or may take the form of a transmission that is capable of increasing or decreasing the number of revolutions experienced by the wheel for every revolution of the output shaft 18 of the motor 12. Optionally, the coupling 16 may include a clutch assembly to selectively engage and disengage the wheel 14 from the output shaft 18. Further, the coupling may optionally include bearings to support the weight of the wheel 14 in a known manner during rotation and to allow the wheel 14 to freely rotate. Providing the coupling 16 with bearings eliminates the need for the weight of the wheel to be supported by the output shaft 18 of the motor 12.

Figure 2:
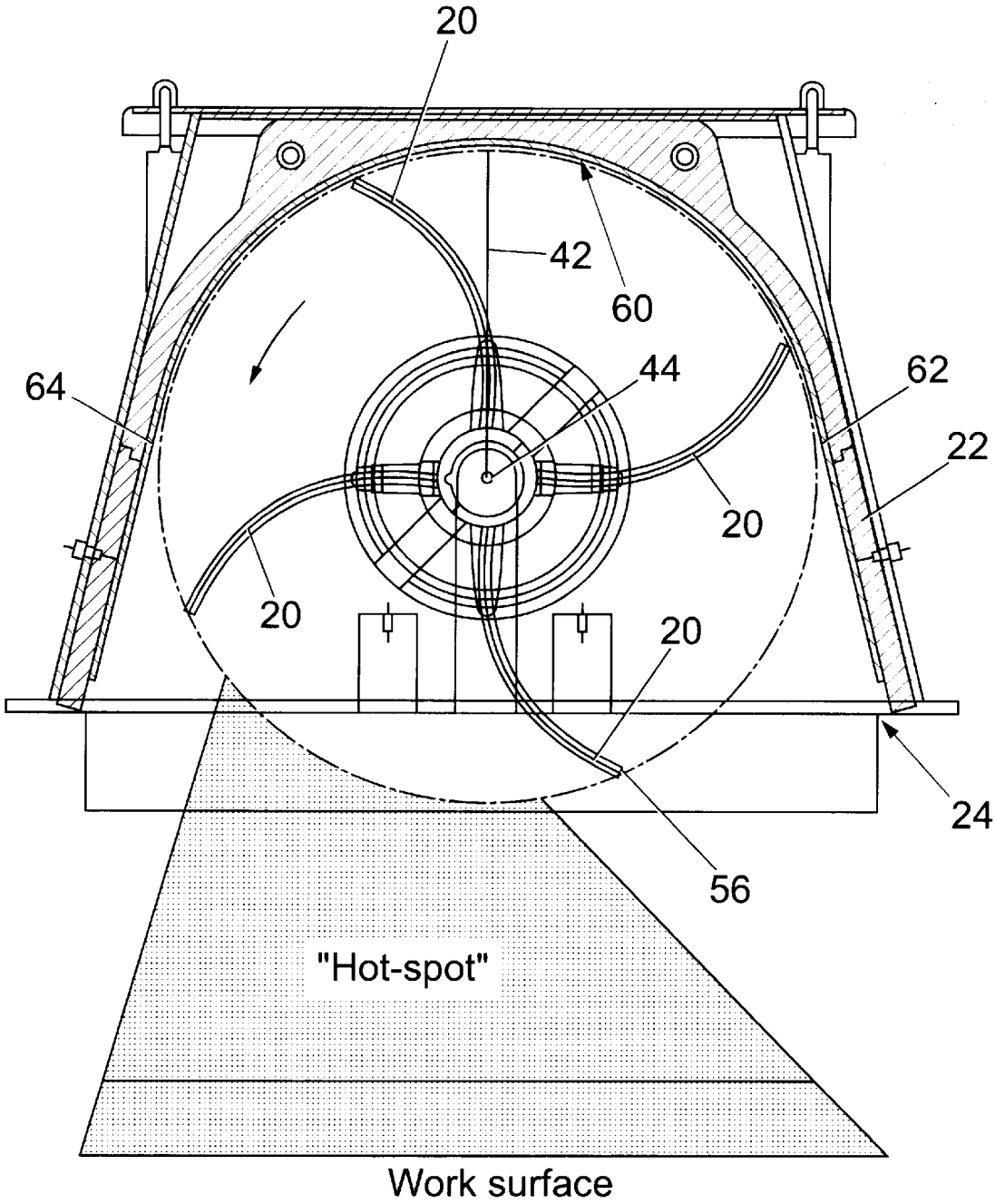
FIG. 2 is an end view, in partial cross-section, of the centrifugal blast apparatus of FIG. 1.
Figure 3:
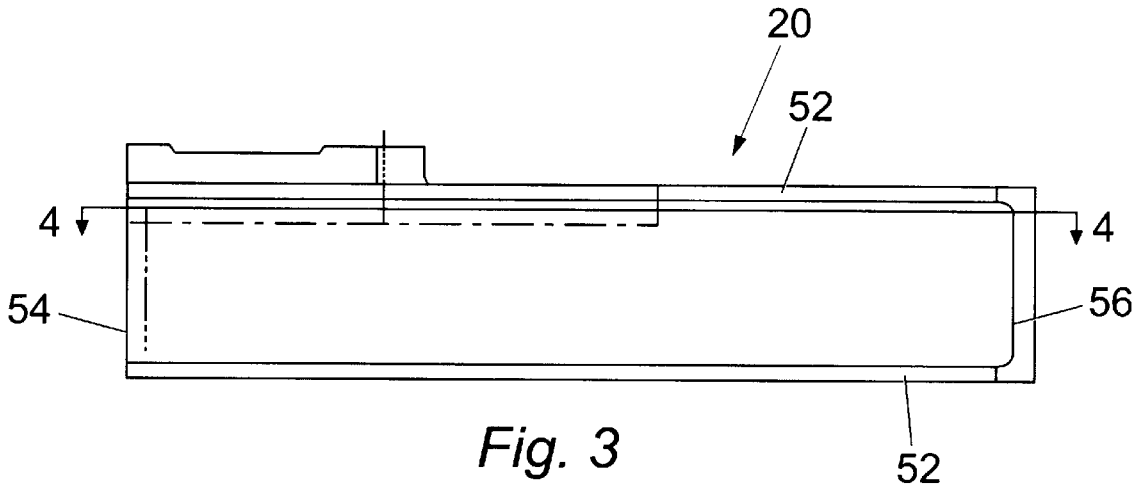
FIG. 3 is a front view of a blade for use in the centrifugal blast apparatus of FIG. 1.

At least one blade 20 is attached to the coupling 16. In the illustrated embodiment, more than one blade is used, and the blades 20 are spaced around an axis of rotation 44 to form a balanced blast wheel. Where only one blade 20 is used, a suitable counterweight may be used to balance the blast wheel 14. The specific characteristics of the blades 20 will be discussed in greater detail below. The blades 20 are configured to receive blast media at a first end 54 adjacent the axis of rotation 44, accelerate the blast media, and deliver the blast media from a second end 56 to a work surface (FIG. 2).

A frame 22 surrounds the blast wheel 14 to prevent accidental injury which might occur if the operator were to inadvertently contact a moving blade. The frame 22 also prevents blast media from being discharged in an unintended direction. Specifically, the frame 22 provides an enclosure around the circumference of the blade with the exception of the blast window 24. Preferably, the frame is formed in such a manner that the gap between the frame and tips of the blades is minimized to prevent abrasive media from being trapped between the frame 22 and blades 20 and crushed therebetween. In the embodiment illustrated in FIG. 2, the frame 22 is formed to be placed closely adjacent an area circumscribed by the tips of the blades 20 when spinning about axis 44. Specifically, the frame 22 in FIG. 2 includes an arcuate section 60 extending approximately between points 62 and 64 on frame 22 and having a radius of curvature slightly larger than a radial distance from the axis 44 to the tip 56 of blade 20, when measured along radial line 42. Optionally, as illustrated in FIG. 1, the frame 22 may additionally enclose the coupling 16 and the output shaft 18 of the motor 12, or even the entire motor 12. In the illustrated embodiment, the frame 22 is attached to and supported on the motor 12.

A hopper 28 is configured to store blast media prior to delivery to the wheel 14. The hopper 28 may be left at least partially open on top or otherwise be provided with a connection to the environment to minimize the likelihood of a vacuum forming in the hopper that could otherwise inhibit flow of the blast media from the hopper. Opening the hopper to the atmosphere or otherwise preventing the formation of a vauum can improve the flow rate of the blast media out of the hopper 28.

In operation, blast media is fed to the blades 20 through a blast media feed system 26 interposed between the hopper 28 and the wheel 14 and configured to convey the blast media from the hopper 28 to the wheel 14. The feed system 26 receives a source of compressed gas, such as air, that is intermixed with the blast media to fluidize the blast media as it is being conveyed to the wheel 14. By fluidizing the blast media, it is possible to minimize the amount of damage done to the blast media.

In the illustrated embodiment, the blast media feed system includes a mixing chamber that receives the blast media from the hopper 28 through a chute 32 and compressed air from a source of compressed air. The compressed air mixes with the blast media in the mixing chamber 30 and fluidizes the blast media. Alternatively, the compressed air may be introduced at any point between the hopper 28 and the mixing chamber 30. The compressed air transports the blast media to a control cage 34 which channels and directs the fluidized blast media and compressed air radially outward to be captured and accelerated by the spinning blades 20. It is believed that the use of compressed air minimize the amount of blast media that is fractured during transportation from the hopper 28 to the blades 20 over mechanical devices such as augers.

Figure 8:
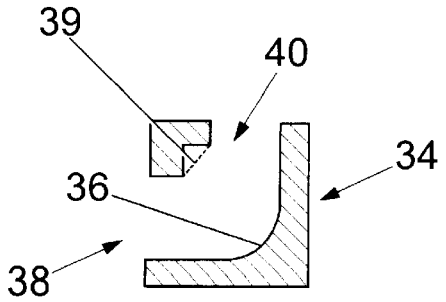
FIG. 8 is a cross-sectional side view of the control cage of FIG. 7 taken along section line 8—8.
Figure 7:
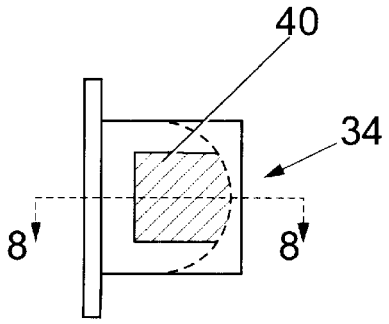
FIG. 7 is a view of a control cage for use in the centrifugal blast apparatus of FIG. 1.

The control cage 34 is used, as in conventional centrifugal blast systems, to direct the blast media onto the blades 20, as well as to control the length and direction of the blast pattern from the wheel. To minimize the amount of blast media that is fractured in the control cage, the surfaces of the control cages are rounded to smoothly redirect the flow of fluidized blast media and compressed air. For example, in the illustrated embodiment shown in greater detail in FIGS. 7 and 8, the control cage 34 has a rounded back surface 36 between an inlet aperture 38 and an outlet aperture 40. The rounded back surface 36 serves to smoothly redirect the flow of compressed air and blast media upward toward outlet aperture 40. By smoothly redirecting the flow of the blast media, it is possible to minimize the amount of blast media that is fractured by passage through the control cage. Optionally, the control cage 34 may be designed to form a nozzle, approaching aperture 40, as shown by the phantom lines 39 in FIG. 8. By forming a nozzle at aperture 40, the flow of compressed air and blast media may be further accelerated after being redirected.

The shape of the aperture 40 at the outlet from the control cage 34 is largely responsible for controlling the amount of blast media delivered to the wheel and the pattern of delivered blast media. The aperture 40 may be any desired shape for media to pass through, such as a circle, oval, rectangle, triangle, or other geometric shape, or an irregularly shaped opening. Additionally, although the illustrated embodiment only has a single aperture, multiple apertures 40 could be present to direct blast media onto different portions of the blade 20 or to direct the blast media onto the blade at different positions during the rotational cycle of the blade. Optionally, a plastic insert may be included at the aperture 40 to cushion the transition of the blast media from the control cage 34 to the blades 20.

The circumferential position of the aperture 40 may be established in a known manner so that the blast media is accelerated by the blades 20 to exit the centrifugal blast apparatus to impinge a work surface. The particular position of the aperture 40 depends on many factors, including the rotational rate of the blades 20, the length of the blades 20, the curvature of the blades, the type of blast media being used, and the speed with which the blast media exits the control cage 34.

Figure 4:
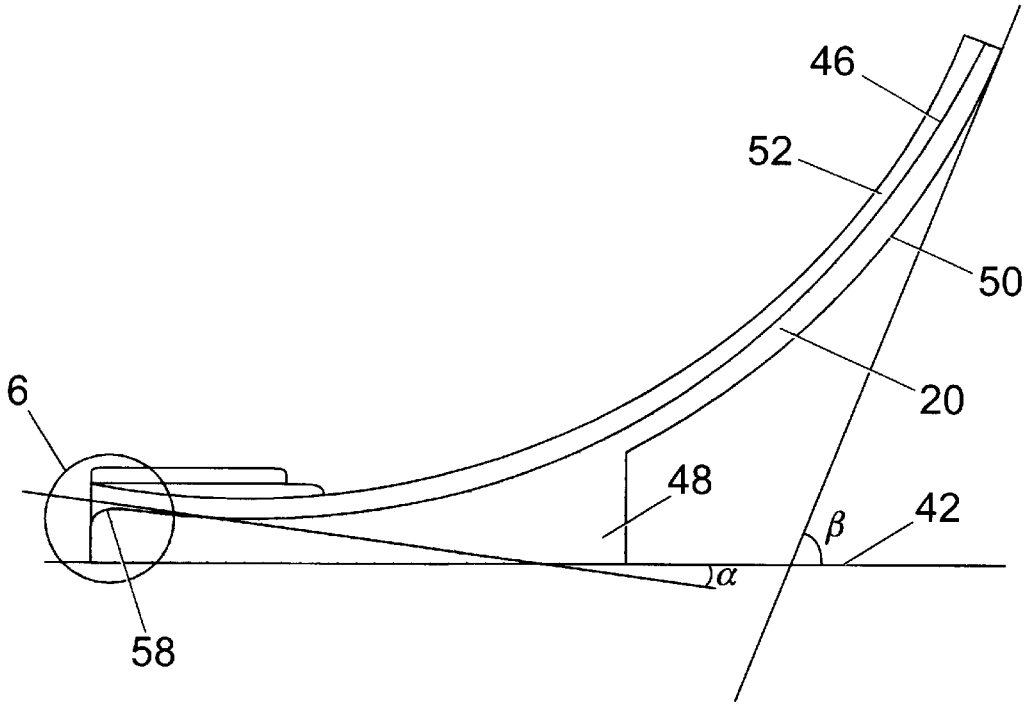
FIG. 4 is a side view, in partial cross-section, of the blade of FIG. 3 taken along section line 4—4.
Figure 5:
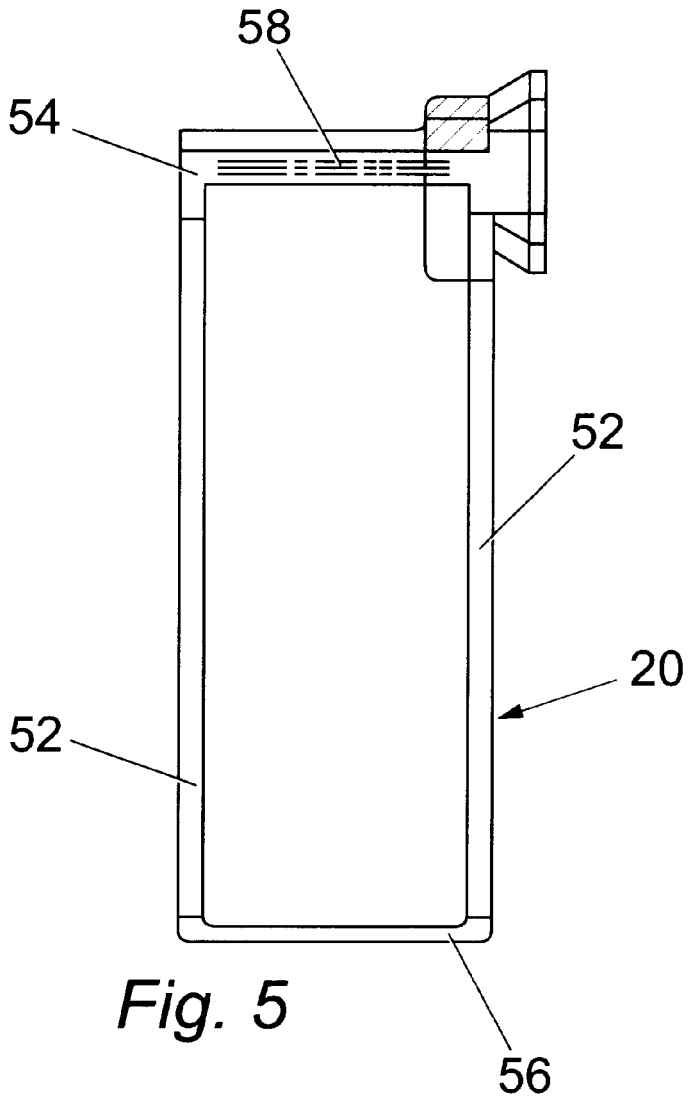
FIG. 5 is a top plan view of the blade of FIG. 3.

The blades 20 are illustrated in greater detail in FIGS. 3–6. As shown in FIG. 4, each blade 20 may be curved relative to a radial line 42 passing through an axis of rotation 44. Curving the blade enhances acceleration of the blast media and thus reduces the rotational rate required to achieve the same blast media exit speed.

Any desired curvature may be used depending on the amount of acceleration required and the type of blast media being used. In the illustrated embodiment, the blade 20 is substantially arcuate, however the invention is not limited to arcuate blades. A first end 54 of the engaging surface 46 of the blade 20 may be formed to extend approximately along a radial line 42, or may form an angle $\alpha$ relative to the radial line 42 as shown in the illustrated embodiment. Likewise, a second end 56 of the blade 20 may form an angle $\beta$ relative to the axial line 42. The particular angles $\alpha$ and $\beta$ may be determined in a manner known in the art and may be based, inter alia, on the rotational rate of the blade 20, the type of blast media being used and the desired exit velocity.

The blade 20 may be provided with a supporting vane 48 to provide greater structural integrity to the blade 20. Additionally, ribs may be formed at least partially along the length of the blade 20 on the back surface 50 of the blade 20 to provide longitudinal stability to the blade 20 and to facilitate removal of the blade 20 for replacement. The present invention is not limited to any particular structural arrangement of the blade 20, and any configuration may be used to provide the necessary structural rigidity. Likewise, any known or suitable attachment system may be used to couple the blade 20 to the coupling 16, as discussed in greater detail above.

In the illustrated embodiment, longitudinal ribs 52 are provided generally along the edges of the engaging surface 46 to form a channel to direct or guide the blast media from the first end 54 to the second end 56 of the blade 20. The profile of the channel formed by the longitudinal ribs 52 may be seen, for example in FIG. 3 at the second end 56 of the blade 20. The profile of the channel may be varied to adjust the spatial density of the blast media impacting the work surface. Additional information regarding the shape of the channel may be found in U.S. patent application Ser. No. 09/252,575, entitled CONVEX BLAST BLADES, the content of which is hereby incorporated by reference.

The surface of the channel may be formed to be smooth to minimize the amount of blast media that is destroyed during the centrifugal acceleration along the surface of the blade. The smooth surface on the blades may be formed while casting the blades or may be formed subsequent to casting by grinding or polishing the blade surfaces. In one embodiment, the surface of the channel is polished to have a roughness average ("Ra") of between 1.6 and 0.05 $\mu$m (between 63 and 2 $\mu$in.), although other surface roughness values may be equally effective in minimizing the amount of blast media that is destroyed by the blades.

The blades 20 may be formed of any hard, durable substance. Preferably, the blades are formed from metal, such as steel or a steel alloy that can withstand high temperatures and will not rapidly deteriorate during operation due to the repetitive impingement of the blast media against the surface of the blades.

Since the blast media enters the wheel 14 through the centrally located control cage 34 during operation, the first end 54 of the blade 20 is the initial part of the blade to contact the blast media. The edge 58 of the first end 54 may be curved to ease the transition of the blast media onto the blade 20 and to minimize the amount of blast media that is broken in the transition from the control cage 34 to the blade 20. The radius of curvature of the curved edge 58 should be selected to minimize the amount of blast media that is broken. Exemplary ranges for the radius of curvature include radii between 1/64 inch and 1/2 inch. More particularly, it has been found that a radius of curvature of approximately 1/8 inch advantageously reduces the amount of blast media that is fractured during the blast process over using a sharp leading edge.

Figure 6:
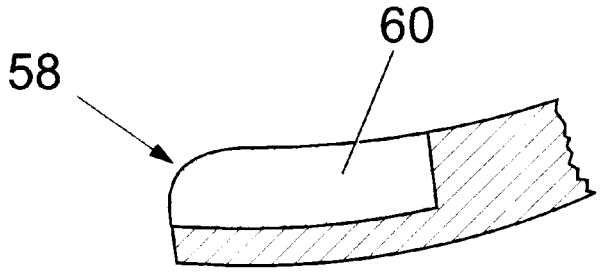
FIG. 6 is an exploded cross-sectional side view of the leading edge of the blade taken from circle 6 of FIG. 4.

In one embodiment, as illustrated in FIG. 4, the curved edge 58 is formed integral with the blade 20. Alternatively, as illustrated in FIG. 6, the curved edge 58 is formed as part of an insert 60 joined to the blade 20 at the first end 54. The insert 60 may be formed of any substance capable of withstanding repeated impact with blast media, yet soft enough to cushion the transition of the blast media from the control cage 34 to the blade 20. Exemplary materials include urethane, ultrahigh molecular weight (UHMW) plastics, and the like.

Operation of the centrifugal blast apparatus 10 described herein with friable blast media has been demonstrated to fracture as little as 2% of the particles of the blast media, a number that is comparable to compressed air blasting systems. Accordingly, with this centrifugal blast apparatus 10, it is possible to achieve all the advantages of using a centrifugal blast apparatus, including increased blast media flow rates, increased coverage, decreased noise and decreased power consumption, while minimizing breakage of the blast media.

It should be understood that various changes and modifications of the embodiments shown in the drawings and described in the specification may be made within the spirit and scope of the present invention. Accordingly, it is intended that all matter contained in the above description and shown in the accompanying drawings be interpreted in an illustrative and not in a limiting sense. The invention is limited only as defined in the following claims and the equivalents thereto.

What is claimed is:

1. A centrifugal blasting apparatus, comprising:

a blade mounted for rotation about an axis of rotation and curved in the direction of rotation, said blade having a first end proximal the axis of rotation and a second end distal the axis of rotation;

a passage configured to deliver blast media from a source of blast media to the blade, said passage having at least one wall configured to smoothly redirect a direction of travel of the blast media; and an inlet formed in the passage and configured to intermix a flow of compressed air with the blast media to facilitate movement of the blast media through the passage.

2. The centrifugal blast apparatus of claim 1, wherein the first end of the blade is curved.

3. The centrifugal blasting apparatus of claim 2, wherein a radius of curvature of the first end is approximately ⅛ inch.

4. The centrifugal blasting apparatus of claim 1, wherein a surface of the blade configured to contact the blast media is relatively smoothly polished.

5. The centrifugal blasting apparatus of claim 2, wherein a surface of the blade configured to contact the blast media is relatively smoothly polished.

6. The centrifugal blasting apparatus of claim 1, the blade further comprising an insert on an edge of the first end.

7. The centrifugal blasting apparatus of claim 6, wherein the insert is formed of a material that is softer than a material forming the blade.

8. The centrifugal blasting apparatus of claim 6, wherein the insert is formed of at least one of urethane, and ultrahigh molecular weight plastics.

9. The centrifugal blasting apparatus of claim 1, wherein the passage comprises a control cage.

10. The centrifugal blasting apparatus of claim 1, further comprising a plurality of similarly configured blades.

11. The centrifugal blasting apparatus of claim 1, wherein the blade comprises a channel configured to direct a path of travel of the blast media from the first end of the blade to the second end of the blade.

12. The centrifugal blasting apparatus of claim 11, wherein said channel is formed from a location adjacent the first end of the blade to a location adjacent the second end of the blade.

13. The centrifugal blasting apparatus of claim 1, wherein the blade further comprises reinforcing ribs.

14. A centrifugal blasting apparatus, comprising:

a motor having a drive shaft and configured to provide motive force to a centrifugal blasting wheel;

a plurality of curved blades connected to the drive shaft, each of said curved blades having a first end proximal the axis of rotation and a second end distal the axis of rotation; and a blast media feed system interposed between a source of blast media and the curved blades, said blast media feed system being configured to receive and intermix a flow of compressed air and a flow of blast media, and being configured to deliver the intermixed flow of compressed air and blast media to the first ends of the blades.

15. The centrifugal blasting apparatus of claim 14, further comprising a coupling device interposed between the blades and drive shaft.

16. The centrifugal blasting apparatus of claim 14, wherein the blades are directly connected to the drive shaft.

17. The centrifugal blasting apparatus of claim 14, wherein the first ends of the blades are curved.

18. The centrifugal blasting apparatus of claim 14, wherein the blast media feed system comprises a control cage and a feed spout, wherein the blast media and compressed air are intermixed in the feed spout, and wherein the control cage is formed to have at least one curved wall configured to smoothly redirect the flow of the intermixed blast media and compressed air from a first direction to a second direction prior to being delivered to the first ends of the blades.

19. A method of accelerating abrasive particles, comprising:

providing a centrifugal blasting apparatus having a plurality of curved blades mounted for rotation about a central axis, each of said plurality of blades having a curved inner edge;

intermixing blast media with compressed air; and delivering the intermixed blast media and compressed air to the curved inner edge of the blades while the blades are rotating about the central axis.

* * * * *